US007976701B2

(12) United States Patent
Nishimoto et al.

(10) Patent No.: US 7,976,701 B2
(45) Date of Patent: Jul. 12, 2011

(54) DRAIN TRAP

(75) Inventors: Shingo Nishimoto, Higashiosaka (JP); Taro Kondoh, Nishinomiya (JP)

(73) Assignee: Kondoh-FRP Co., Ltd., Osaka (JP)

( * ) Notice: Subject to any disclaimer, the term of this patent is extended or adjusted under 35 U.S.C. 154(b) by 258 days.

(21) Appl. No.: 11/662,667

(22) PCT Filed: Apr. 11, 2006

(86) PCT No.: PCT/JP2006/307654

§ 371 (c)(1), (2), (4) Date: Jan. 15, 2008

(87) PCT Pub. No.: WO2007/116531

PCT Pub. Date: Oct. 18, 2007

(65) Prior Publication Data

US 2009/0050546 A1 Feb. 26, 2009

(51) Int. Cl.
*E03C 1/288* (2006.01)

(52) U.S. Cl. ..... 210/119; 137/247.21; 137/533.15

(58) Field of Classification Search ..... 210/116, 210/117, 119; 137/247.21, 533.13, 533.15
See application file for complete search history.

(56) References Cited

U.S. PATENT DOCUMENTS 741,815 A * 10/1903 Morrison ..... 137/247.21

FOREIGN PATENT DOCUMENTS

| | | |
|---|---|---|
| JP | 52-3057 | 6/1950 |
| JP | 51-16493 | 5/1976 |
| JP | 55-51902 | 12/1980 |
| JP | 6-34450 | 9/1994 |
| JP | 6-76489 | 10/1994 |
| JP | 07-071784 | 3/1995 |
| JP | 07-45661 | 10/1995 |
| JP | 8-239883 | 9/1996 |
| JP | 10-300117 | 11/1998 |
| JP | 2004-197453 | 7/2004 |
| JP | 2005-336956 | 12/2005 |
| JP | 2006-112154 | 4/2006 |

* cited by examiner

*Primary Examiner* — Terry K Cecil
(74) *Attorney, Agent, or Firm* — The Webb Law Firm

(57) ABSTRACT

To provide a drain trap which makes it possible to easily clean the interior of a main body and accurately seal a junction between storage space and discharge space partitioned by a partition. The drain trap includes the main body which has a tubular shape with a closed end and includes inner space communicated with a receiving unit and a discharge unit; a lid; and the partition which partitions the inner space of the main body into the storage space and discharge space, in which the partition can be inserted into the inner space, sealing units are installed on the partition and a side wall of the main body to bring part of the partition into intimate contact with part of the side all by exerting a vertical force component under a vertical pressing force, and the partition is equipped with a valve disc which floats up to allow liquid to flow from the storage space to the discharge space when the liquid in the storage space reaches or exceeds a set amount as well as with a valve seat which catches and supports the valve disc.

11 Claims, 5 Drawing Sheets

(a)

(b)

DRAIN TRAP

TECHNICAL FIELD

The present invention relates to a drain trap that comprises a main body which has a tubular shape with a closed end and includes inner space communicated with a receiving unit and a discharge unit; a lid which covers the inner space; and a partition which partitions the inner space into storage space and discharge space, where the storage space stores liquid received from the receiving unit and the discharge space discharges liquid to the discharge unit.

BACKGROUND ART

Drain traps such as described above are installed, for example, in drainage paths which discharge liquid such as drain water of air conditioners to drainage basins. Being equipped with a normally-closed valve disc which floats up to allow liquid to flow from the storage space to the discharge space when the liquid in the storage space reaches or exceeds a set amount, such a drain trap prevents backflow of contaminated air and bad odors using a water sealing action of the liquid stored in the storage space and closing action of the valve disc.

Conventional drain traps include one which comprises a ball-shaped valve disc; a tubular valve disc guide tube which guides movements of the valve disc; a partition which, being constructed integrally with a main body, partitions inner space of the main body into storage space and discharge space; and a valve seat which, being constructed integrally with the partition, catches and supports the valve disc, in which the valve disc guide tube is configured to be insertable into the inner space of the main body (see, for example, Patent Document 1).

In the drain trap described in Patent Document 1, the partition is constituted of a plate-like body which partitions the inner space of the main body into L-shaped storage space and rectangular discharge space when viewed from a side. The partition which is a plate-like body is constructed integrally with the main body, extending inward from a side wall of the main body. The valve seat is installed in such a location on the partition that corresponds to an opening which communicates the storage space and discharge space.

[Patent Document 1]: Japanese U.M. Application "kokai" No. 52-3057

DISCLOSURE OF THE INVENTION

Problems to be Solved by the Invention

In the drain trap above described in Patent Document 1, since the partition is constructed integrally with the main body and the valve seat is constructed integrally with the partition, the drain trap is assembled by mounting the lid on the main body with the valve disc guide tube inserted in the inner space of the main body.

When cleaning the interior of the main body, the valve disc guide tube is removed from the inner space of the main body. However, since the partition is constructed integrally with the main body, even if the valve disc guide tube is removed from the inner space of the main body, side walls and a bottom of the main body are hidden behind the partition. In the drain trap described in Patent Document 1, hidden parts include the side wall of the main body on which the receiving unit is installed, that part of the partition which opposes the side wall, the entire bottom of the main body, and that part of the partition which opposes the bottom. Consequently, when cleaning the hidden parts, i.e., the side wall of the main body, bottom of the main body, and part of the partition, it is necessary to insert a cleaning device, for example, through an opening formed in the partition, making it difficult to perform a cleaning operation.

Also, since drain traps store liquid in storage space, the side walls and bottom of the main body and part of the partition which form the storage space can easily become contaminated. In the case of the drain trap described in Patent Document 1, since it has the L-shaped storage space when viewed from a side, a channel which passes liquid has a reduced width and tends to get clogged easily due to contamination and the like, increasing the need to clean the side walls and bottom of the main body and part of the partition which form the storage space. However, with the drain trap described in Patent Document 1, since the side walls and bottom of the main body and part of the partition which form the storage space are hidden, it is difficult to clean the parts which greatly need cleaning, which fact presents a notable problem.

The present invention has been made in view of the above points and has an object to provide a drain trap which makes it possible to clean the interior of a main body easily.

Means for Solving the Problem

To achieve the above object, according to one feature of the present invention, there is provided a drain trap comprising: a main body which has a tubular shape with a closed end and includes inner space communicated with a receiving unit and a discharge unit; a lid which covers the inner space; and a partition which partitions the inner space into storage space and discharge space, where the storage space stores liquid received from the receiving unit and the discharge space discharges liquid to the discharge unit, characterized in that the partition can be inserted into the inner space, sealing units are installed on the partition and a side wall of the main body to bring part of the partition into intimate contact with part of the side wall by exerting a vertical force component under a vertical pressing force, and the partition is equipped with a valve disc which floats up to allow liquid to flow from the storage space to the discharge space when the liquid in the storage space reaches or exceeds a set amount as well as with a valve seat which catches and supports the valve disc.

When installing the partition by inserting it into the inner space of the main body, a vertical pressing force is exerted on the sealing units installed on the partition and side wall of the main body. The sealing units installed on the partition and side wall of the main body bring part of the partition into intimate contact with part of the side wall by exerting a vertical force component under the pressing force. In this way, since the sealing units installed on the partition press the sealing units installed on the side wall of the main body by exerting the vertical force component, the sealing units on the partition and side wall of the main body are brought into intimate contact with each other accurately.

The partition inserted into the inner space of the main body can be removed from the inner space, and the valve disc and valve seat are installed on the partition. Thus, by removing the partition from the inner space of the main body, it is possible to reveal the side wall and bottom of the main body which have been hidden by the partition, making it easy to clean the interior of the main body.

This provides a drain trap which makes it possible to clean the interior of the main body easily while bringing the storage space and discharge spaces separated by the partition into intimate contact with each other accurately.

According to another feature of the present invention, in the drain trap, the sealing unit installed on the side wall of the main body is a shoulder provided all around a circumference of the side wall and the sealing unit installed on the partition is provided circumferentially all around a circumference of the partition.

When inserting the partition into the inner space of the main body, the partition provided circumferentially all around the circumference of the partition is brought into intimate contact with the shoulder provided all around the circumference of the side wall of the main body by exerting a vertical force component. In this way, since the inner space of the main body is partitioned vertically into the storage space and discharge space and the sealing units work effectively all around the circumference of the side wall of the main body, junction between the storage space and discharge space can be sealed properly with higher accuracy.

According to another feature of the present invention, in the drain trap, the sealing units on the partition and on the side wall of the main body undergo a vertical pressing force exerted by the lid as the lid is installed on the main body.

When the lid is installed on the main body, the sealing units on the partition and side wall of the main body come into intimate contact with each other by exerting a vertical force component under the action of the vertical pressing force applied by the lid. This makes it possible to easily bring the sealing units into intimate contact with each other simply by installing the lid on the main body without the need to otherwise apply a vertical pressing force to the sealing units on the partition and side wall of the main body.

According to another feature of the present invention, in the drain trap, a shielding member is installed between the lid and the partition inserted in the inner space, the shielding member being placed in intimate contact with the lid and having a reduced coefficient of friction with respect to the partition; and the lid can be installed on the main body with the shielding member placed between the lid and the partition inserted in the inner space as threads formed on the main body and the lid are screwed together.

Since the lid can be installed on the main body by screwing together the threads formed on the main body and the lid, when installing the lid on the main body, the vertical pressing force can be applied to the sealing units on the partition and side wall of the main body precisely.

Also, since the shielding member placed between the lid and the partition inserted in the inner space comes into intimate contact with the lid and has a reduced coefficient of friction with respect to the partition, when the threads formed on the main body and the lid are screwed together, the shielding member can slide over the partition while remaining in intimate contact with the lid. This makes it possible to install the lid on the main body precisely by pressing the partition inserted in the inner space against the shielding member.

According to another feature of the present invention, in the drain trap, an entire bottom of the main body is used for the storage space.

By using the entire bottom of the main body for the storage space, it is possible to increase the area of the storage space in a planar view. This makes it possible to secure a volume required of the storage space while keeping the height of the storage space to a minimum and thus minimize the height of the drain trap and thereby reduce the size of the drain trap.

According to another feature of the present invention, in the drain trap, the main body and the partition are transparent while the valve disc is colored in such a way as to be distinguishable from the main body.

The valve disc can be recognized visually from out of the main body with the partition inserted in the main body. Thus, by checking the position of the valve disc, it is possible to check easily whether the partition and the valve disc are installed in place.

According to another feature of the present invention, in the drain trap, the partition has legs which protrude upward from the inner space when the partition is inserted upside down into the inner space.

If the partition is inserted upside down into the inner space, the legs protrude upward from the inner space, preventing installation of the lid on the main body. This prevents a mistake in vertical orientation of the partition when inserting the partition into the inner space.

According to another feature of the present invention, in the drain trap, the side wall of the main body and the partition have such shapes in a planar view as to position the partition properly in a horizontal direction when the partition is inserted into the inner space.

When inserting the partition into the inner space, if the horizontal position of the partition with respect to the inner space is appropriate, the partition can be inserted into the inner space without being restricted by the shape of the wall of the main body or its own shape in a planar view. However, if the horizontal position of the partition with respect to the inner space is inappropriate, the partition cannot be inserted into the inner space, being restricted by the shape of the wall of the main body or its own shape in a planar view. This prevents a mistake in horizontal positioning of the partition with respect to the inner space when inserting the partition into the inner space.

According to another feature of the present invention, in the drain trap, a resin member serving as a height adjustment member is installed in such a way as to hold the sealing unit on the partition from upper and lower sides, where the height adjustment member adjusts that part of the discharge space which faces the discharge unit on the side wall to be level with a lower end of the discharge unit when the partition is inserted into the inner space.

Since the resin member is installed in such a way as to hold the sealing unit on the partition from upper and lower sides, the sealing units on the partition and sealing units on the side wall of the main body are brought into intimate contact with each other with the resin member interposed between them. This makes it possible to bring the sealing units into intimate contact with each other properly with higher accuracy.

Since the height adjustment member adjusts that part of the discharge space which faces the discharge unit to be level with the lower end of the discharge unit, it is possible to prevent liquid from being stored in that part of the discharge space which faces the discharge unit. This prevents corrosion caused by the liquid. Moreover, since the height adjustment member is constituted of the resin member, there is no need to install a special member for height adjustment, which simplifies configuration accordingly.

BEST MODE FOR CARRYING OUT THE INVENTION

An embodiment of a drain trap according to the present invention will be described with reference to the drawings.

As shown in FIGS. 1 to 4, the drain trap 1 comprises a main body 5 which has a tubular shape with a closed end and includes inner space 4 communicated with a receiving unit 2 and a discharge unit 3; a lid 6 which covers the inner space 4; and a partition 9 which partitions the inner space 4 into storage space 7 and discharge space 8, where the storage space 7 stores liquid received from the receiving unit 2 and the discharge space 8 discharges liquid to the discharge unit 3.

FIG. 1 is a longitudinal sectional view of the drain trap 1, FIG. 2 is a sectional view taken along line B-B in FIG. 1, FIG. 3 is a sectional view taken along line A-A in FIG. 1, FIG. 4 is an external perspective view of the drain trap 1, and FIG. 5 is an exploded perspective view of the drain trap 1.

The main body 5 has a tubular shape with a planar bottom. The receiving unit 2 and discharge unit 3 are disposed in an opposing relation to each other on sides of the main body 5, constituting a flow path which extends in a transverse direction. The receiving unit 2 and discharge unit 3 are disposed in such a way that the receiving unit 2 will be slightly higher (e.g., 5 mm) than the discharge unit 3. The height difference between the receiving unit 2 and discharge unit 3 is designed to make it easier for liquid to flow from the receiving unit 2 to the discharge unit 3.

The partition 9 is composed of a first partition 10 which has a tubular shape and second partition 11 which has a plate-like shape and extends outward from around the circumference of the first partition 10. The first partition 10 has a cut 12 produced by cutting away part of its circumference in a vertical direction as well as an opening 13. The opening 13 is placed in an opposing relation to the cut 12. The second partition 11 is installed around the first partition 10, sloping continuously, with the lowest part corresponding to the center of the cut 12 and the highest part corresponding to a location which opposes the center of the cut 12.

When inserted into the inner space 4 of the main body 5, the partition 9 is configured to partition the inner space 4 of the main body 5 into a lower part and upper part, the lower part serving as the storage space 7 and the upper part serving as the discharge space 8. In this way, as the partition 9 partitions the inner space 4, the entire bottom of the main body 5 is used for the storage space 7.

A ball-shaped valve disc 15 and a valve seat 16 are installed on the partition 9 where the valve disc 15 floats up to allow liquid to flow from the storage space 7 to the discharge space 8 when the liquid in the storage space 7 reaches or exceeds a set amount and the valve seat 16 catches and supports the valve disc 15. The valve seat 16 is ring-shaped and is placed in inner space of the first partition 10. The valve disc 15, which is a normally-closed type, closes an opening of the ring-shaped valve seat 16.

As indicated by a dotted line in FIG. 1, when liquid in the storage space 7 reaches or exceeds a set amount, the valve disc 15 floats up from the valve seat 16 and opens the opening, causing the liquid to flow from the storage space 7 to the discharge space 8 and be discharged from the discharge unit 3. When the liquid in the storage space 7 falls below the set amount, the valve disc 15 descends and closes the opening by being caught and supported by the valve seat 16. The first partition 10 guides the valve disc 15 so that the latter will float up and descend along a vertical direction.

As indicated by a solid line in FIG. 1, the position at which the valve seat 16 catches and supports the valve disc 15 is close to the center of the valve disc 15 in the vertical direction. As indicated by a dotted line in FIG. 1, the position of the liquid surface at which the valve disc 15 floats up is close to the lower end of the valve disc 15 in the vertical direction. In this way, the position of the liquid surface at which the valve disc 15 floats up is lower than the position at which the valve seat 16 catches and supports the valve disc 15. Incidentally, the position of the liquid surface at which the valve disc 15 floats up can be set lower than the position at which the valve seat 16 catches and supports the valve disc 15, by changing the diameter or weight of the valve disc 15 as required.

The position at which the valve disc 15 is liable to contamination is the position of the liquid surface at which the valve disc 15 floats up, and this position is lower than the position at which the valve seat 16 catches and supports the valve disc 15. This makes it possible to prevent contamination of the valve seat 16. By preventing contamination of the valve seat 16, it is possible to prevent adhesion of the valve seat 16 and valve disc 15, and thereby ensure that the valve disc 15 will float up.

The valve seat 16 is disposed on the partition 9 in such a way that it will be lower than a lower end 3*a* of the discharge unit 3 when the partition 9 is inserted into the inner space 4 of the main body 5. A discharge point at which liquid is discharged from the discharge unit 3 is set higher than a float point at which the valve disc 15 floats up from the valve seat 16 in order to prevent the valve disc 15 from floating up from, and descending to, the valve seat 16 repeatedly in a short period of time, and thereby reduce noise.

For example, if the discharge point and float point are set at the same height, the moment the valve disc 15 floats up from the valve seat 16, liquid is discharged from the discharge unit 3, causing a fall in the liquid level of the liquid stored in the storage space 7. Thus, if a very small amount of liquid flows from the receiving unit 2 to the storage space 7, immediately after the valve disc 15 floats up from the valve seat 16, the liquid level in the storage space 7 falls below the float point, causing the valve disc 15 to descend to the valve seat 16. Then, immediately after the valve disc 15 descends, the liquid level rises above the float point, causing the valve disc 15 to float up from the valve seat 16. In this way, the valve disc 15 floats up from, and descends to, the valve seat 16 repeatedly in a short period of time. Each contact between the valve disc 15 and valve seat 16 produces a sound, resulting in noise.

Thus, the discharge point is set higher than the float point to provide a time lag between the time when the valve disc 15 floats up from the valve seat 16 and the time when the liquid is discharged from the discharge unit 3. The time lag prevents the valve disc 15 from floating up from, and descending to, the valve seat 16 repeatedly in a short period of time even if a very small amount of liquid flows from the receiving unit 2 to the storage space 7, and thereby reduces noise.

Also, the valve seat 16 is located above the lower end of the first partition 10 in the vertical direction, and the first partition 10 has a leading edge 10*a* which extends below the valve seat 16. Regarding positional relationship of the first partition 10 and valve seat 16, the lower end of the first partition 10 is set to be lower than the lower end of the valve disc 15 caught and supported by the valve seat 16, when the partition 9 is inserted into the inner space 4 of the main body 5. Due to the presence of the leading edge 10*a*, the storage space 7 is formed into a U-shaped flow path which turns around at the bottom of the main body 5 so that the storage space 7 will be water-sealed by the liquid stored in it. Also, since the lower end of the first partition 10 is configured to be lower than the lower end of the valve disc 15 caught and supported by the valve seat 16, the storage space 7 is always water-sealed by the liquid stored in it when the valve disc 15 floats up from the valve seat 16.

Also, a shielding member 17 is installed between the lid 6 and the partition 9 inserted into the inner space 4, where the shielding member 17 comes into intimate contact with the lid 6 and has a reduced coefficient of friction with respect to the partition 9. The shielding member 17 is disc-shaped and made of resin such as silicon. The upper surface of the shielding member 17 which comes into contact with the lid 6 adheres to the rear face of the lid 6 by suction effect. The lower surface of the shielding member 17 which comes into contact with the partition 9 inserted into the inner space 4 has been processed to be slippery to reduce the friction coefficient of the lower surface of the shielding member 17 with respect to the partition 9.

The lid 6, which has a circular shape in a planar view, can be installed on the main body 5 with the shielding member 17 interposed between the lid 6 and the partition 9 inserted into the inner space 4 as threads 18 formed on the main body 5 and lid 6 are screwed together.

Sealing units 14 are installed on the partition 9 and the side wall 5*a* of the main body 5, where the sealing units 14 bring part of the partition 9 into intimate contact with an entire circumference of a side wall 5*a* of the main body 5 by exerting a vertical force component under a vertical pressing force applied by the lid 6 as the lid 6 is installed on the main body 5. The sealing units 14 consist of a body-side sealing unit 14*a* installed on the side wall 5*a* of the main body 5 and partition-side sealing unit 14*b* installed on the partition 9.

The body-side sealing unit 14*a* is a shoulder provided all around a circumference of the side wall 5*a*, protruding inward from the side wall 5*a*. The shoulder or the body-side sealing unit 14*a* is installed circumferentially all around the circumference of the main body 5, sloping continuously, with the lowest part corresponding to the center of the receiving unit 2 and the highest part corresponding to the center of the discharge unit 3.

The partition-side sealing unit 14*b*, which is an outer edge of the second partition 11, is provided circumferentially all around a circumference of the partition 9, where the second partition 11 is installed around the partition 9, sloping continuously across the entire circumference of the partition 9. A resin member 20 (e.g., elastomer resin) is installed on the partition-side sealing unit 14*b* in such a way as to hold the partition-side sealing unit 14*b* from upper and lower sides.

With the partition 9 inserted into the inner space 4 of the main body 5, the lid 6 is screwed onto the main body 5 by means of the threads 18, with the shielding member 17 interposed between the lid 6 and the partition 9. At this time, the lid 6 presses the partition 9 downward, applying a downward pressing force to the body-side sealing unit 14*a* and partition-side sealing unit 14*b*. The body-side sealing unit 14*a* and partition-side sealing unit 14*b* come into intimate contact with each other as the downward pressing force presses the partition-side sealing unit 14*b* against the body-side sealing unit 14*a*. In this way, the body-side sealing unit 14*a* and partition-side sealing unit 14*b* are brought into intimate contact with each other all around the side wall 5*a* of the main body 5, sealing the junction between the storage space 7 and discharge space 8 properly with high accuracy.

The resin member 20 is installed on the partition-side sealing unit 14*b*, serving as a height adjustment member 21 which adjusts that part 8*a* of the discharge space 8 which faces the discharge unit 3 on the side wall 5*a* to be level with the lower end 3*a* of the discharge unit 3 when the partition 9 is inserted into the inner space 4.

That is, in that part on the side wall 5*a* of the main body 5 which corresponds to the discharge unit 3 in the circumferential direction, the shoulder constituting the body-side sealing unit 14*a* is located below the lower end 3*a* of the discharge unit 3. Thus, when the partition 9 is inserted into the inner space 4, that part 8*a* of the discharge space 8 which faces the discharge unit 3 is lower than the lower end 3*a* of the discharge unit 3. For this reason, the height adjustment member 21 is installed to prevent liquid from being stored in that part of the discharge space 8 which faces the discharge unit 3, and thereby prevent corrosion caused by the liquid. The height adjustment member 21 is constituted of the resin member 20 installed on the partition-side sealing unit 14*b*.

As shown in FIG. 6, the partition 9 has legs 19 which protrude upward from the inner space 4 when the partition 9 is inserted upside down into the inner space 4. The legs 19 are installed at intervals in the circumferential direction of the first partition 10, extending downward from the lower end of the first partition 10. If the partition 9 is inserted upside down into the inner space, the legs 19 protrude upward from the inner space 4, preventing installation of the lid 6 on the main body 6. This prevents a mistake in vertical orientation of the partition 9 when inserting the partition 9 into the inner space 4.

The side wall 5*a* of the main body 5 and the partition 9 have such shapes in a planar view as to position the partition 9 properly in a horizontal direction when the partition 9 is inserted into the inner space 4. Raised portions 22 whose inner edges are linear in a planar view are formed on the main body 5, projecting inward from those inner circumferential parts which are located between the receiving unit 2 and discharge unit 3. As shown in FIG. 7(*a*), the side wall 5*a* of the main body 5 in a planar view has an elongated approximately elliptical shape consisting of a pair of circular arcs linked by the linear parts. As shown in FIG. 7(*b*), the partition 9 in a planar view has an elongated approximately elliptical shape consisting of a pair of circular arcs linked by the linear parts. The first partition 10 is disposed at a location displaced in the longitudinal direction from the center of the partition 9 which has an approximately elliptical shape in a planar view.

In this way, the side wall 5*a* of the main body 5 and partition 9 have an elongated approximately elliptical shape with at least two inside diameters in a planar view, and appropriate horizontal position of the partition 9 with respect to the inner space 4 is such that longitudinal ends of the two elliptical shapes overlap each other. If the horizontal position of the partition 9 with respect to the inner space 4 is inappropriate, the partition 9 cannot be inserted into the inner space 4. This prevents a mistake in horizontal direction of the partition 9 when inserting the partition 9 into the inner space 4.

The main body 5 and the partition 9 are transparent while the valve disc 15 is colored (e.g., blue) in such a way as to be distinguishable from the main body 5 and the partition 9. This allows an operator to visually recognize position of the valve disc 15 from out of the main body 5 with the partition 9 inserted in the inner space 4 of the main body 5. This makes it possible to check whether the partition 9 and the valve disc 15 are installed in place.

Lateral part of the lid 6 is covered with a reflector 23 (such as reflective tape) over the entire circumference. Thus, even if the drain trap 1 is installed in a ceiling cavity, the operator can easily recognize the installation location of the drain trap 1 by illuminating the reflector 23. There is a possibility that various paths other than the drainage path have been installed. In that case, a specific color such as red can be assigned to the reflector 23 used for the drainage path 3 of the drain trap 1 and another color such as yellow can be used for another path to assign different colors to different paths.

Other Embodiments (1) In the above embodiment, the body-side sealing unit 14*a* is constituted of the shoulder installed circumferentially all around the circumference of the side wall 5*a* of the main body 5 and the partition-side sealing unit 14*b* is installed circumferentially all around the circumference of the partition 9, but the sealing units have only to bring part of the partition 9 into intimate contact with part of the side wall 5*a* by exerting a vertical force component. Specifically, for example, the sealing unit on the side wall 5*a* of the main body 5 may be constituted of a shoulder installed on part of the circumference of the side wall 5*a* and the sealing unit on the partition 9 may be installed on part of the circumference of the partition 9.

(2) In the above embodiment, the body-side sealing unit 14*a* and partition-side sealing unit 14*b* are installed, sloping continuously, the body-side sealing unit 14*a* and partition-side sealing unit 14*b* may be stepped in the vertical direction, making it unnecessary to install the body-side sealing unit 14*a* as well as the partition-side sealing unit 14*b* in continuity.

(3) In the above embodiment, the body-side sealing unit 14*a* and partition-side sealing unit 14*b* undergo a vertical pressing force exerted by the lid 6 as the lid 6 is installed on the main body 5, but a member other than the lid 6 may apply a vertical pressing force to the body-side sealing unit 14*a* and partition-side sealing unit 14*b*.

(4) In the above embodiment, the lid 6 can be screwed onto the main body 5 by means of the threads 18, but the method for installing the lid 6 on the main body 5 may be changed as required and the lid 6 may be configured to be a fit type which is fitted over the main body 5.

(5) In the above embodiment, the bottom of the main body 5 is planar and the entire bottom of the main body 5 is used for the storage space 7, but the entire bottom of the main body 5 may be used for the storage space 7 by installing a step on it or otherwise changing its shape as required.

(6) In the above embodiment, the side wall 5*a* of the main body 5 and partition 9 have an approximately elliptical shape in a planar view, but they may have another shape such as a rectangular shape, as required.

(7) In the above embodiment, the valve disc 15 is ball-shaped as an example, but it may be configured to be a plate-like body swingable around a horizontal axis or configured otherwise as required.

INDUSTRIAL UTILITY

The present invention can be applied to drain traps equipped with a main body which has a tubular shape with a closed end and includes inner space communicated with a receiving unit and a discharge unit, a lid which covers the inner space, and a partition which partitions the inner space into storage space and discharge space.

DESCRIPTION OF THE REFERENCE NUMERALS AND SIGNS

Figure 1:
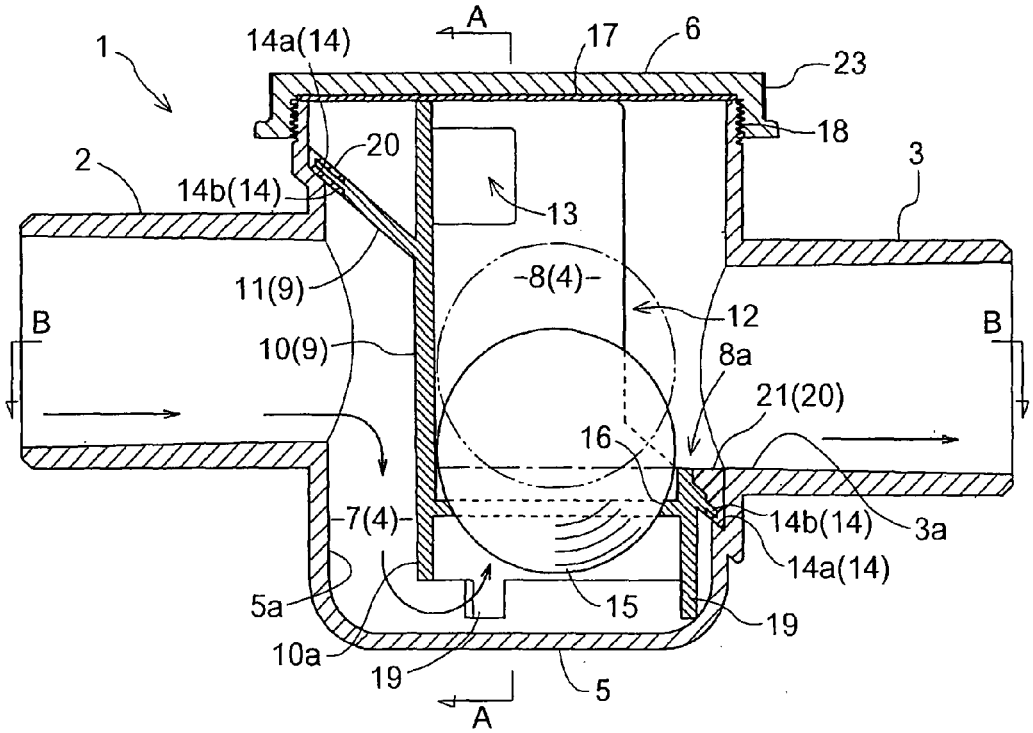
[FIG. 1] A longitudinal sectional view of a drain trap.
Figure 2:
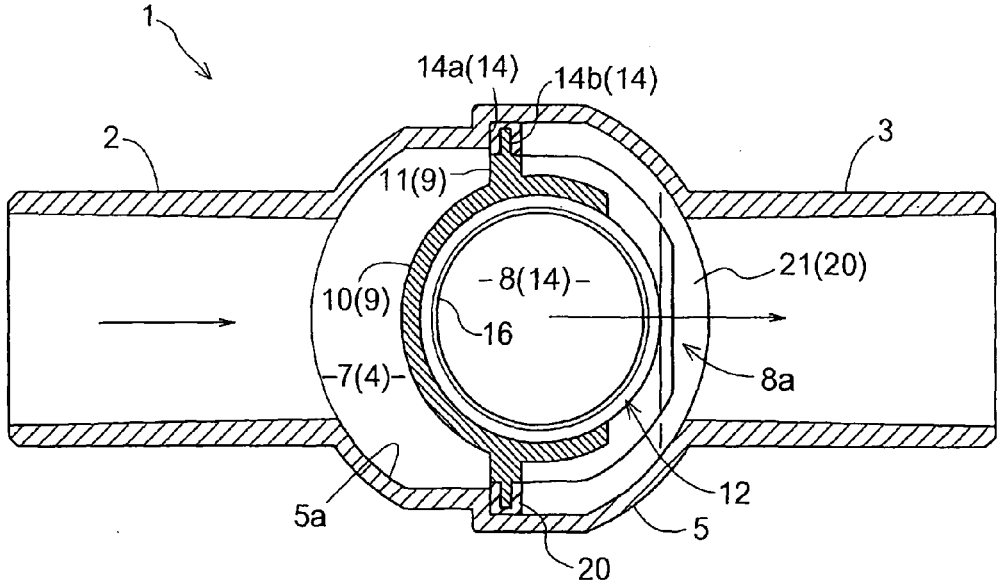
[FIG. 2] A sectional view taken along line B-B in FIG. 1.
Figure 3:
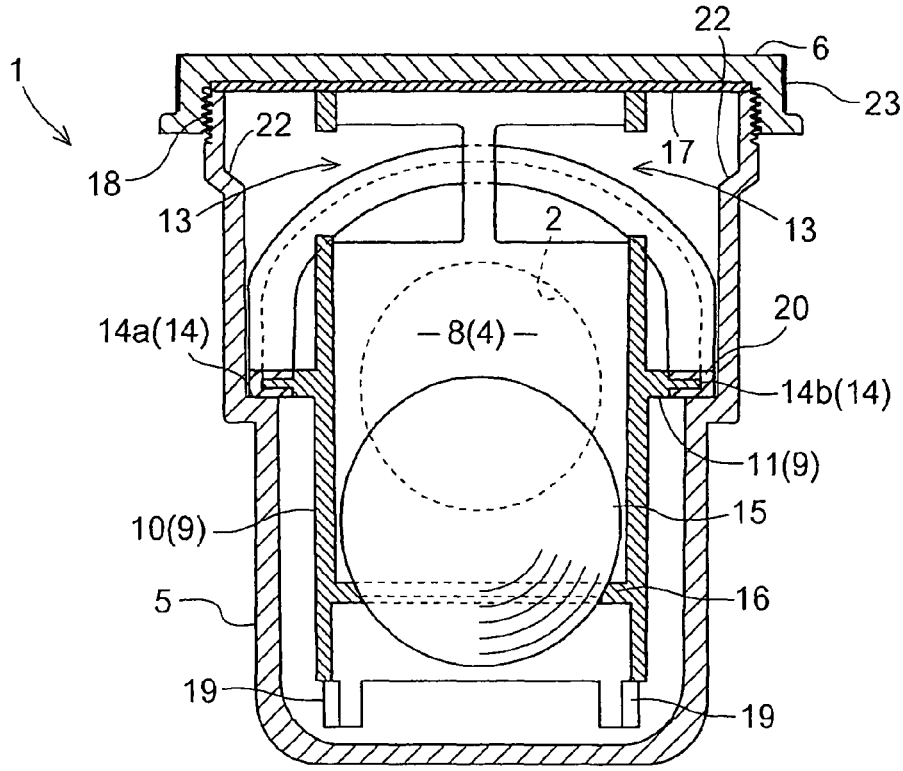
[FIG. 3] A sectional view taken along line A-A in FIG. 1.
Figure 4:
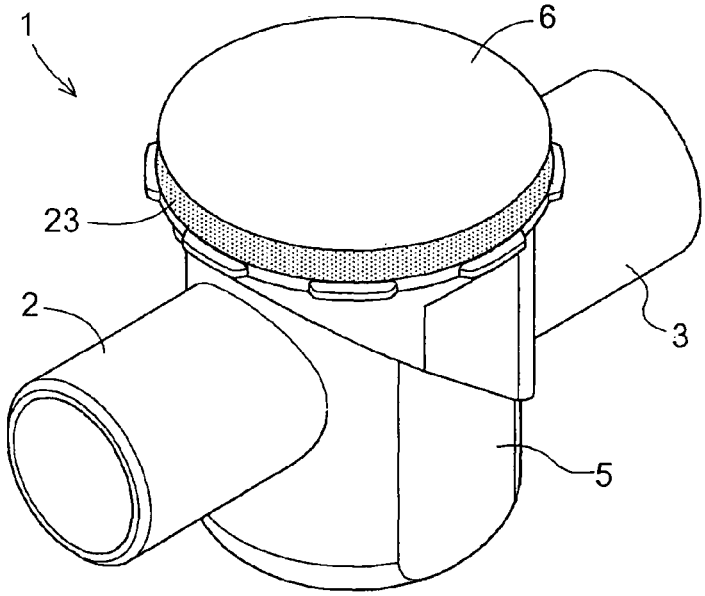
[FIG. 4] An external perspective view of the drain trap.
Figure 5:
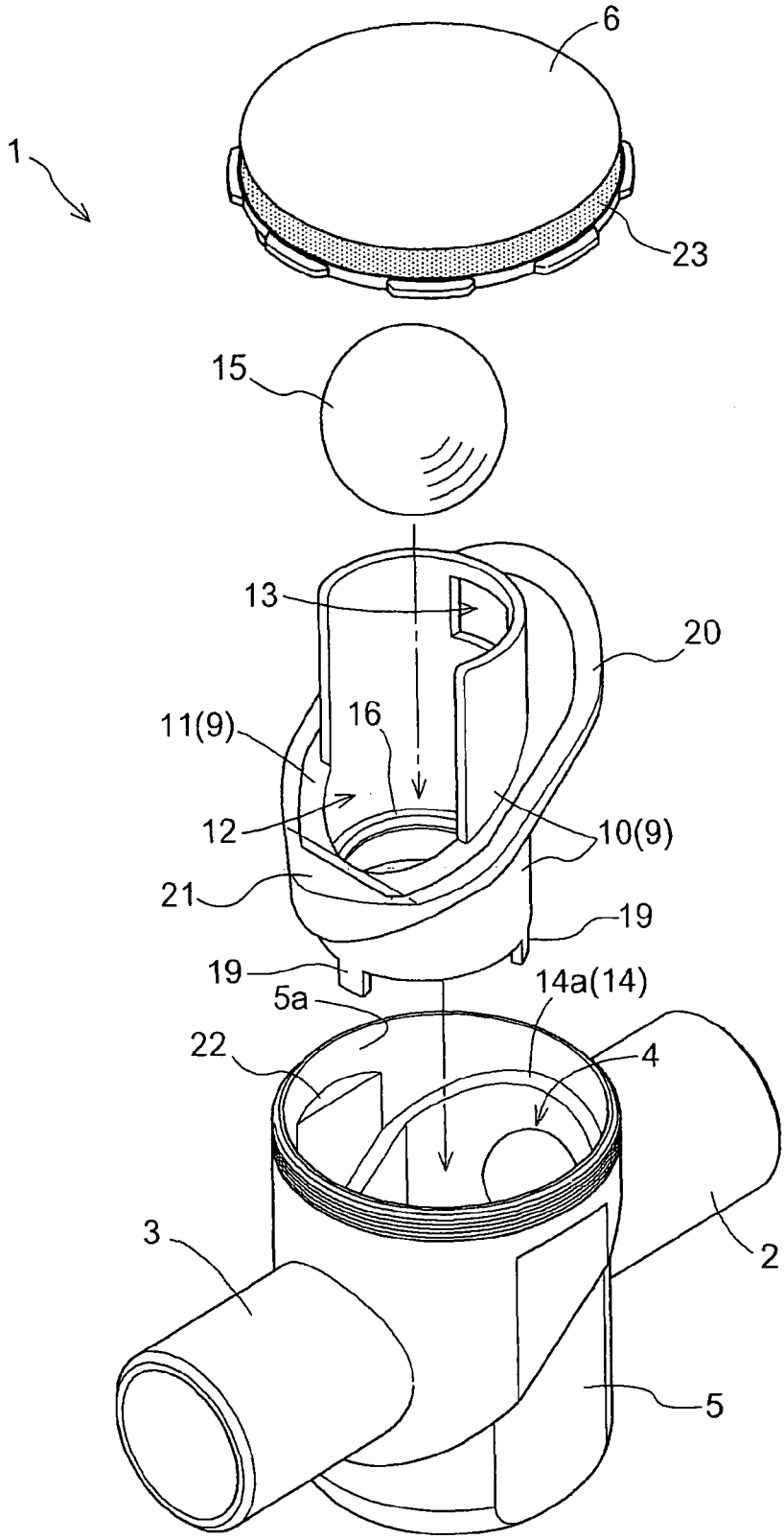
[FIG. 5] An exploded perspective view of the drain trap.
Figure 6:
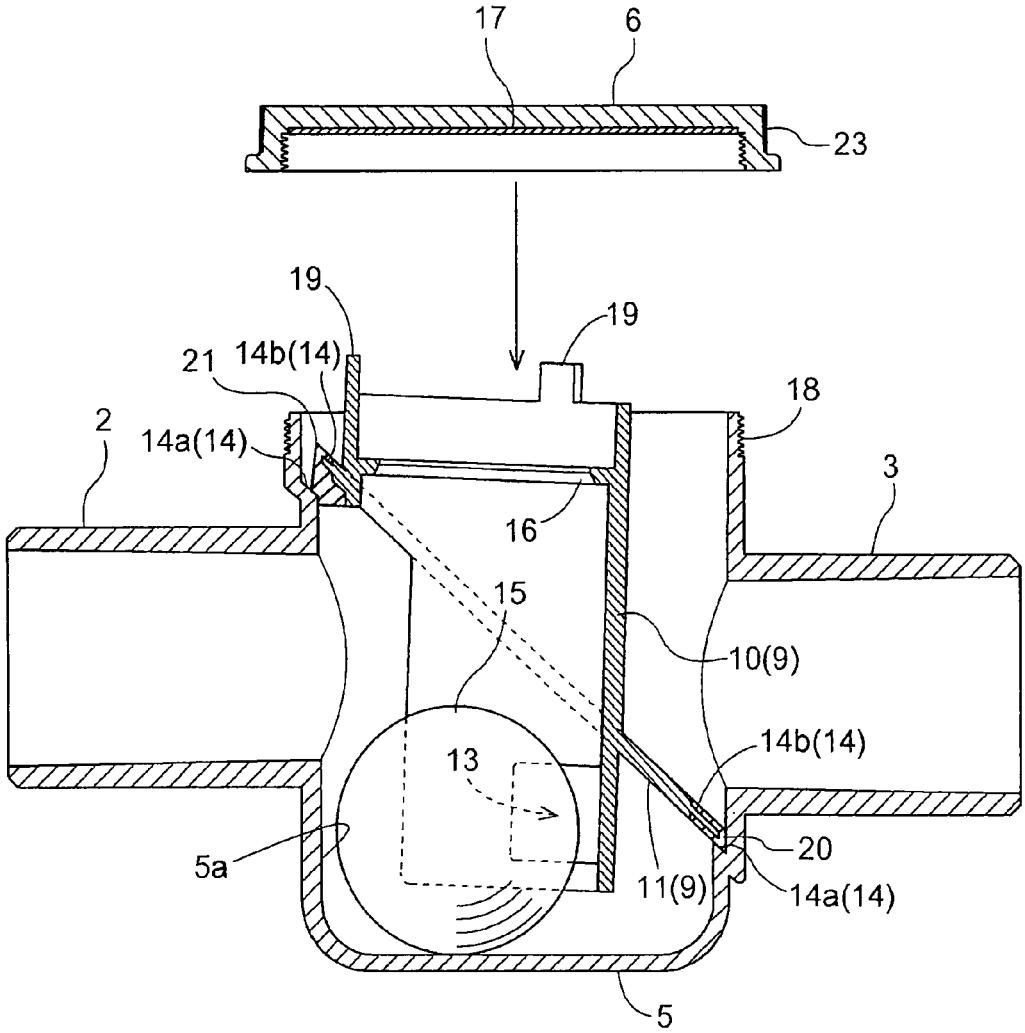
[FIG. 6] A diagram showing a partition inserted upside down into inner space of a main body.
Figure 7:
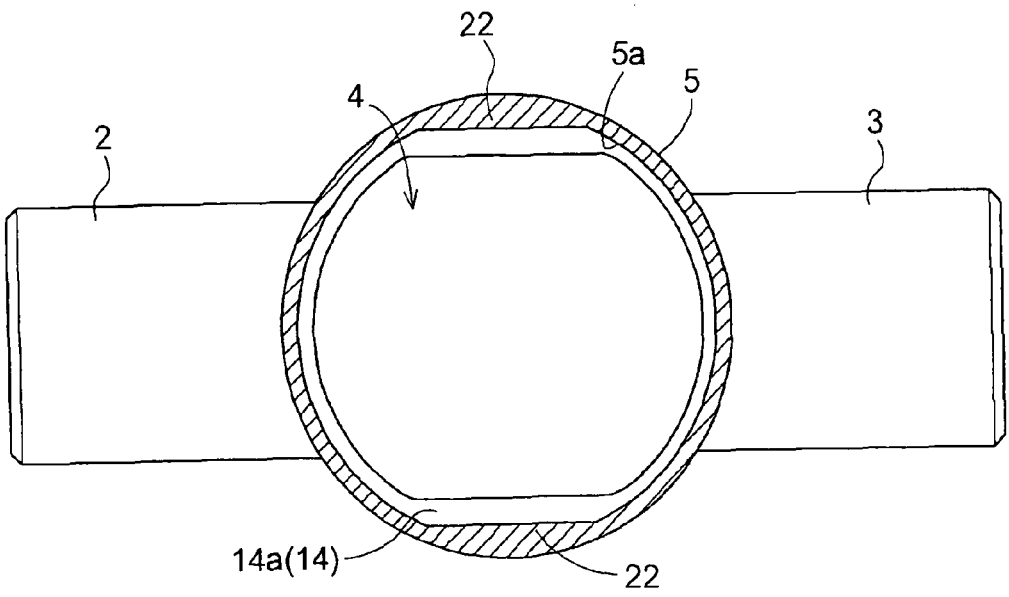
[FIG. 7] A diagram showing shape of a side wall of the main body and shape of the partition in a planar view.
Figure 7:
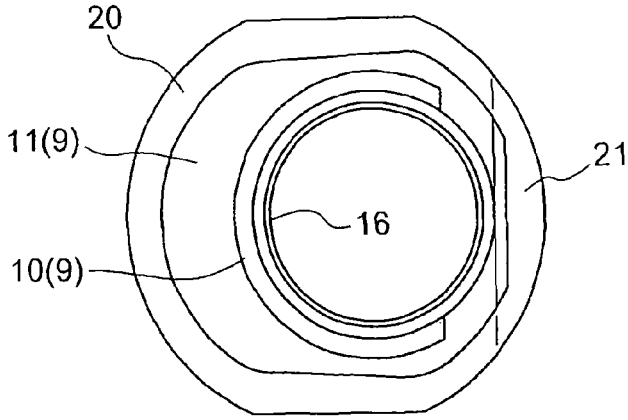

2 Receiving unit
3 Drainage unit
4 Inner space
5 Main body
6 Lid
7 Storage space
8 Discharge space
9 Partition
14 Sealing unit
14*a* Body-side sealing unit installed on main body
14*b* Partition-side sealing unit installed on partition
15 Valve disc
16 Valve seat
17 Shielding member
18 Threads
19 Leg
20 Resin member
21 Height adjustment member

The invention claimed is:

1. A drain trap comprising:

a main body which has a tubular shape with a closed end and which includes an inner space communicated with a receiving unit and a discharge unit;

a lid which covers the inner space; and a partition which partitions the inner space into a storage space and a discharge space, where the storage space stores liquid received from the receiving unit and the discharge space discharges liquid to the discharge unit, wherein the partition includes a tubular first partition and a second partition extending outward from around the circumference of the first partition, and can be inserted into the inner space, sealing units are installed all around circumferences of the partition and a side wall of the main body to bring part of the second partition into intimate contact with part of the side wall by exerting a vertical force component under a vertical pressing force, a slanting contact portion is provided for receiving the vertical pressing force to come into contact with at least part of the sealing units, and the partition is equipped with a valve disc which floats up to allow liquid to flow from the storage space to the discharge space when the liquid in the storage space reaches or exceeds a set amount as well as with a valve seat which catches and supports the valve disc.

2. The drain trap according to claim 1, wherein the sealing unit installed on the side wall of the main body is a shoulder provided all around a circumference of the side wall and the sealing unit installed on the partition is provided circumferentially all around a circumference of the partition.

3. The drain trap according to claim 2, wherein the sealing units on the partition and on the side wall of the main body undergo a vertical pressing force exerted by the lid as the lid is installed on the main body.

4. The drain trap according to claim 3, wherein:

a shielding member is installed between the lid and the partition inserted in the inner space, the shielding member being placed in intimate contact with the lid and having a reduced coefficient of friction with respect to the partition; and the lid can be installed on the main body with the shielding member placed between the lid and the partition inserted in the inner space as threads formed on the main body and the lid are screwed together.

5. The drain trap according to claim 1, wherein the sealing units on the partition and on the side wall of the main body undergo a vertical pressing force exerted by the lid as the lid is installed on the main body.

6. The drain trap according to claim 5, wherein:

a shielding member is installed between the lid and the partition inserted in the inner space, the shielding member being placed in intimate contact with the lid and having a reduced coefficient of friction with respect to the partition; and the lid can be installed on the main body with the shielding member placed between the lid and the partition inserted in the inner space as threads formed on the main body and the lid are screwed together.

7. The drain trap according to claim 1, wherein an entire bottom of the main body is used for the storage space.

8. The drain trap according to claim 1, wherein the main body and the partition are transparent while the valve disc is colored in such a way as to be distinguishable from the main body.

9. The drain trap according to claim 1, wherein the partition has legs which protrude upward from the inner space when the partition is inserted upside down into the inner space.

10. The drain trap according to claim 1, wherein the side wall of the main body and the partition have such shapes in a planar view as to position the partition properly in a horizontal direction when the partition is inserted into the inner space.

11. The drain trap according to claim 1, wherein a resin member serving as a height adjustment member is installed in such a way as to hold the sealing unit on the partition from upper and lower sides, where the height adjustment member adjusts that part of the discharge space which faces the discharge unit on the side wall to be level with a lower end of the discharge unit when the partition is inserted into the inner space.

* * * * *

UNITED STATES PATENT AND TRADEMARK OFFICE

CERTIFICATE OF CORRECTION

PATENT NO. : 7,976,701 B2
APPLICATION NO. : 11/662667
DATED : July 12, 2011
INVENTOR(S) : Shingo Nishimoto et al.

It is certified that error appears in the above-identified patent and that said Letters Patent is hereby corrected as shown below:

Cover Page, Column 2, Abstract, Line 12, "side all" should read -- side wall --

Signed and Sealed this
Twenty-ninth Day of November, 2011

David J. Kappos

David J. Kappos
*Director of the United States Patent and Trademark Office*